US005293961A

United States Patent [19]

Postema

[11] Patent Number: 5,293,961

[45] Date of Patent: Mar. 15, 1994

[54] METHOD AND APPARATUS FOR FABRICATING ARCUATE WOODEN STRUCTURES

[76] Inventor: Leonard F. Postema, 830 Ranchwood Trail, Woodstock, Ga. 30188

[21] Appl. No.: 932,882

[22] Filed: Aug. 20, 1992

[51] Int. Cl.[5] ..... B27D 1/00; B27N 1/00

[52] U.S. Cl. ..... 144/349; 144/256.1; 144/263; 144/266; 144/348; 144/352; 156/443; 269/81; 269/93; 269/297; 269/318; 269/319

[58] Field of Search ..... 156/443; 144/256.1, 144/256.3, 259, 262, 263, 264, 265, 266, 348, 352, 349; 269/25, 32, 60, 81, 93, 156, 289, 297, 305, 309, 318, 319, DIG. 910

[56] References Cited

U.S. PATENT DOCUMENTS

| | | | |
|---|---|---|---|
| 927,975 | 7/1909 | Kaufman et al. | 144/256.1 |
| 1,052,405 | 2/1913 | Breece | 144/263 |
| 2,350,915 | 6/1944 | Miller | 144/266 |
| 4,688,612 | 8/1987 | Kessel et al. | 144/371 |
| 4,711,281 | 12/1987 | Kessel et al. | 144/256.1 |
| 4,886,568 | 12/1989 | Strozier | 156/443 |
| 4,967,816 | 11/1990 | Postema | 144/266 |

FOREIGN PATENT DOCUMENTS

| | | | |
|---|---|---|---|
| 2209 | 7/1860 | United Kingdom | 144/263 |

*Primary Examiner*—W. Donald Bray
*Attorney, Agent, or Firm*—Hopkins & Thomas

[57] ABSTRACT

An apparatus for fabricating arched wooden structures such as headers for window and door jambs, said apparatus comprising a mandrel table having a planar bed from which a plurality of rigid arms upwardly extend. Each of the arms is movable on the bed so that the arms can be positioned to define and form in conjunction with each other an arcuate shaped mandrel about which wooden planks are to be bent into arched structures. A clamp secures a long work piece at its center to the mandrel intermediate the ends of the mandrel and a flexible steel band is wrapped tightly and progressively about the mandrel on either side of the clamp to bend each end section of the work piece about and conform it to the shape of the mandrel.

18 Claims, 7 Drawing Sheets

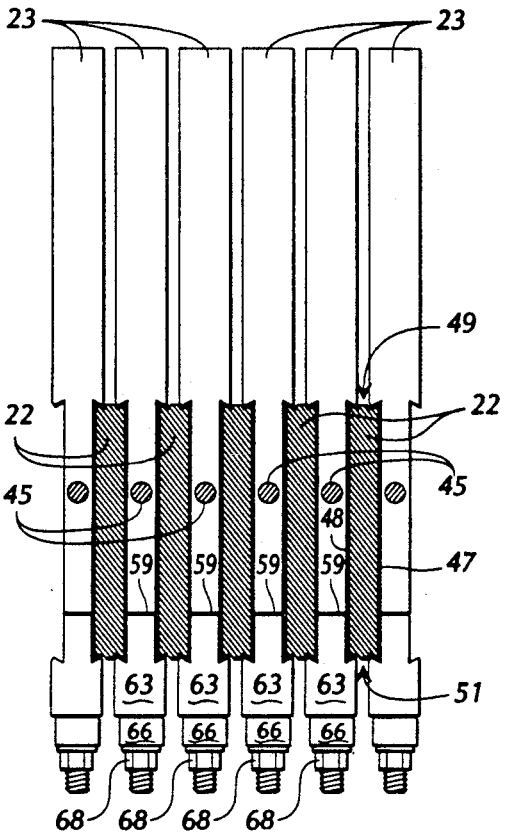
FIG. 2
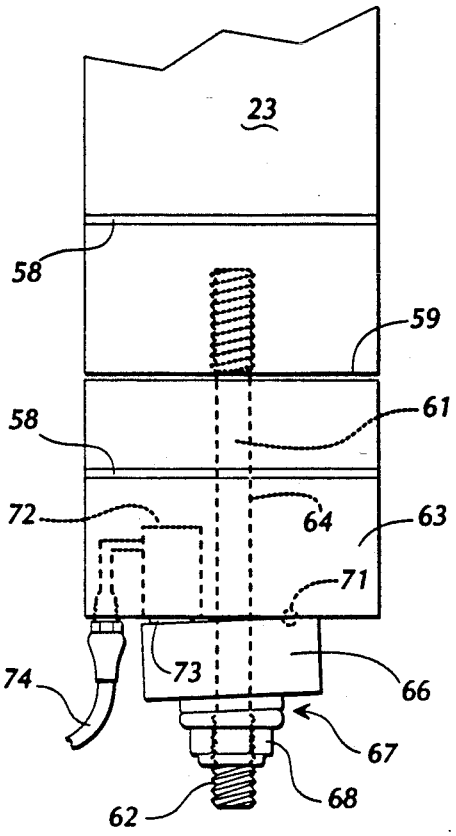
FIG. 3
FIG. 2A
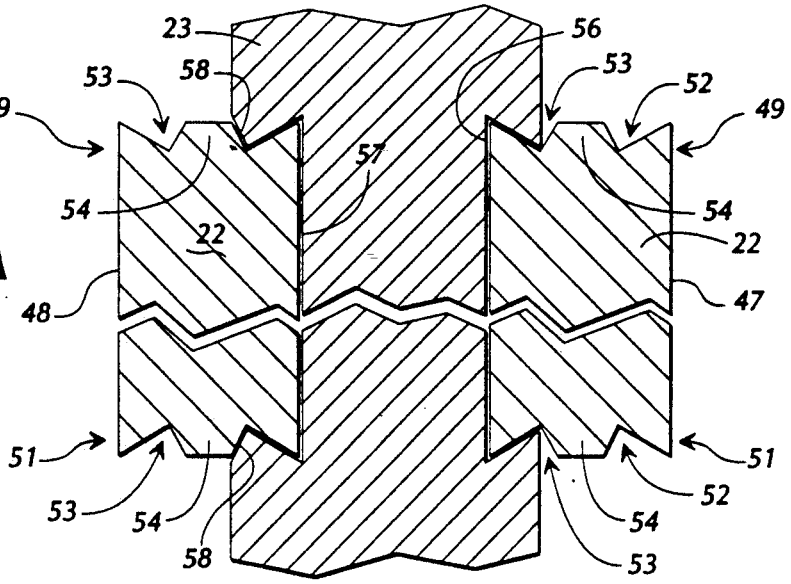

METHOD AND APPARATUS FOR FABRICATING ARCUATE WOODEN STRUCTURES

TECHNICAL FIELDS

This invention relates in general to woodworking and in particular to the automated fabrication of arcuate wooden structures such as arched headers for doors and window jambs.

BACKGROUND OF THE INVENTION

Windows and doorways with arcuate or arched headers have long been popular architectural additions to homes and commercial buildings. Such windows and doorways typically include a wooden jamb that has spaced vertical side members joined at their top ends by a curved or arched wooden header. Although the vertical members of such jambs are easily fabricated, reliable economic methods of fabricating high quality arched wooden headers have long evaded woodworking craftsmen.

One traditional method of crafting arched headers has been to join a series of mitered wooden blocks at their ends to form the general shape of the arch. The curve is then cut with a band-saw from the joined blocks to form the arched header, which can then be machined if desired and secured to the upper ends of vertical door jamb members. Clearly, headers fabricated manually in this way exhibit a number of problems and shortcomings. The butt joints between the joined wooden blocks, for example, tend to separate over time due to temperature and moisture induced expansion and contraction of adjacent blocks. Further, such headers usually are not suitable for staining because the skewed relative orientations of the wood grain in adjacent blocks is not considered visually attractive. Consequently, arched headers fabricated in this traditional way often are limited to use in door and window frames that are to be painted.

A less manual method of fabricating arched headers has been to stack a plurality of thin wooden planks with adhesive applied between the planks to form a laminated board. The board is then placed atop a convex form and the ends of the board are forced down toward the ends of the form to bend the board around the form and thus produce a laminated arcuate wooden header. While this method indeed represents an improvement over manual fabrication techniques, it nevertheless exhibits certain inherent drawbacks. For example, bending the laminated board into an arcuate form with pressure applied downwardly on each end results in having upward pressure applied to the center portion of the board and little or no pressure applied intermediate the center portion and the ends of the board. As a result, the individual planks of the laminated board are prone to crack and are subject to a significant amount of surface friction and sliding motion between layers that interferes with proper compression of the lamina. In addition, the relatively thick adhesive tends to become trapped between individual lamina in excessive amounts due to surface imperfections in the lamina, ripples formed in the lamina during bending, and uneven application of pressure. As a result, the quality of products produced by this method is at best unpredictable and sometimes even unacceptable.

Another known method of forming arcuate wooden structures is a mass production operation in which hydraulic presses are used to form arches from laminated boards. In this method, an arcuate ram is forced with hydraulic pressure into a corresponding concave form with the laminated board being trapped and compressed between the ram and the form. While this method usually is capable of producing large quantities of headers, it is inherently unsuitable for custom work since the shape of the form and ram is unchangeable. In addition, this mass production method necessitates the use of exceedingly thin highly flexible lamina, which detracts from the appearance of the final product and adds to the cost. Many of the problems of cracking and uneven glue flow that are inherent in other prior art methods also are present with the hydraulic press method.

An improvement over these prior art methods is embodied in the device disclosed in applicant's own U.S. Pat. No. 4,967,816 wherein a plurality of arms are slidably mounted on radially extended spokes. The arms can be positioned on the spokes to define an arcuate shaped mandrel whereupon a wooden board of laminated planks is progressively bent around and held against the mandrel from one of its ends to the other. Even though this device and method is a significant improvement over previous offerings, it nevertheless embodies certain problems and shortcomings inherent in its own design. For example, the arms that extend outwardly from the spokes to form the mandrel tend to flex or bend slightly inwardly as the board is bent around the mandrel so that the mandrel surface becomes slightly cone shaped. This can result in less than desirable glue joints on one side of the finished arched structure because of reduced pressure on the smaller side of the slightly cone shaped mandrel. Also, each of the arms in this device must be carefully adjusted to extend outwardly from its spoke at a precise right angle in order that the mandrel formed by the arms exhibit a smooth continuous curve. Also, while semi-circles and slightly elongated ellipses can be formed with the device of applicant's previous patent, the formation of highly elliptical arches or of unusual shapes such as cathedral arches have proven impractical or even impossible to produce because of the highly uneven and asymmetrical forces imparted to the arms and spokes of the device when attempting to form such shapes.

Thus it is clear that a continuing need exists for an apparatus and method of forming arcuate wooden structural members such as headers for door and window jambs that overcomes the disadvantages and shortcomings of the prior art, that is capable of forming highly elliptical or unusually shaped arches, and that can be operated reliably and economically to produce arched wooden structures of a quality superior to that of structures produced by prior art methods and devices. It is to the provision of such an apparatus and method that the present invention is primarily directed.

SUMMARY OF THE INVENTION

Briefly described, the present invention comprises an improved apparatus and method for producing arcuate structures such as arched or cathedral shaped headers for doors and window jambs. The apparatus includes a frame that supports a generally horizontal mandrel table assembly. The mandrel table assembly includes a substantially planar bed formed by a multitude of elongated spaced parallel ribs. A rigid metal elongated arm is slidably secured at its bottom end between each pair of ribs and extends upwardly from the bed at substantially a right angle. In the preferred embodiment, the bed has left and right halves and a pair of arms is slidably secured between each pair of ribs with one arm located on the right half of the bed and the other arm located on the left.

With the just described mandrel table configuration, it will be seen that a multitude of rigid arms extend upwardly from the bed of the mandrel table and each arm can be slid along the length of the ribs between which it is captured to position the arm at a selected location across the width of the table. In this way, the arms can be positioned on the table so that vertical surfaces of the arms align to define and form a curved or arched mandrel extending upwardly from the bed and having a shape corresponding to that of arched wooden structures to be produced. Locking means is provided on the lower end of each arm below the mandrel table to lock each arm in its mandrel forming position on the bed and simultaneously to couple and lock the arms and the ribs of the bed together to form an extremely rigid substantially monolithic mandrel structure about which laminated wooden boards can be bent into arched shapes.

A stainless steel band extends between the take-up drums of two take-up drum assemblies that are positioned on either side of the mandrel table. The take-up drum assemblies, in turn, are each mounted to a massive carriage that is adapted to be moved on the frame across the mandrel table from the top end to the bottom end thereof. As the carriage moves with the take-up drum assemblies positioned on either side of a mandrel formed on the table, the stainless steel band that extends between the drums of the assemblies engages the mandrel at the apex of its arch. As the carriage moves further, the band is paid out from the take-up drums and wrapped progressively about each half of the mandrel from its apex to its terminal end portions. A caliper brake assembly is provided on each of the take-up drums to resist the paying out of the stainless steel band from the drums so that tremendous tension can be imparted to the band as it is wrapped about the mandrel.

A hydraulically operated clamp assembly is mounted to the frame adjacent to the apex position of arched shapes formed on the mandrel table and the stainless steel band is attached at its center portion to the clamping face of the clamp assembly. The clamp assembly is adapted to be activated to move its clamping face toward engagement with the apex of the mandrel just before the band is wrapped about the mandrel. In this way, a board to be bent about the mandrel is securely clamped at the apex of the mandrel before its ends are wrapped progressively around each side of the mandrel by the advancing band.

In use, the arms of the mandrel table are positioned to define an arched mandrel of desired shape and a plurality of wooden planks are stacked together with adhesive between the planks to form a long laminated board. The board is then placed on the machine adjacent the apex of the mandrel's arch with the center portion of the board located next to the apex of the arch. The clamp assembly is then hydraulically actuated to capture and clamp the board at its center portion securely against the apex of the mandrel and the take-up drum assemblies are positioned along the carriage to straddle the breadth of the mandrel.

With the board thus clamped and the drum assemblies adjusted, the caliper brakes of the drum assemblies are engaged and the carriage is moved slowly over the mandrel table from its top to its bottom. As the carriage moves, the stainless steel band is paid out from the take-up drums and is wrapped tightly and securely about the mandrel with the laminated board becoming progressively captured between the band and the mandrel. The caliper brakes can be adjusted to provide a desired resistance to the paying out of the band so that extreme tension can be imparted to the band and thus extreme force applied to the laminated board to gather it progressively toward and firmly against the mandrel. The board is thus bent progressively about and formed in the shape of the mandrel.

Once the laminated board has been bent and shaped about the mandrel, the adhesive can be cured in a conventional manner such as with high frequency current whereupon the carriage is moved back to unwrap the band from about the board and mandrel. Since the adhesive is cured with the board bent about the mandrel, the board retains the arched shape of the mandrel and can be further processed to create a finished arched wooden header.

The device of this invention offers numerous significant advantages over devices of the prior art. For example, the arms of the mandrel table are capable of being positioned to form virtually any arched shape from semi-circles to cathedral arches and even non-symmetrical shapes wherein one side of the arch is not a mirror image of the other side. Further, the construction of the mandrel table insures that when the arms are locked in position, the ribs of the table bed and the arms are mechanically coupled and tightly locked together to form a highly rigid substantially monolithic mandrel structure that does not flex or move as boards are bent around the mandrel. The clamping of a work piece at the apex of a mandrel arch and the progressive bending of the work piece from the apex around each side of the arch also provides substantial advantages, particularly when forming highly elongated or non-symmetrical arched shapes such as cathedral headers.

It is therefore an object of this invention to provide an improved apparatus for fabricating arched wooden headers wherein the mandrel about which work pieces are bent is lockable to form a rigid and non-flexing structure.

Another object to the invention is to provide a device for fabricating arched wooden structures that is capable of producing highly elongated structures such as cathedral arches and non-symmetrically shaped arches just as easily as it forms semi-circular or elliptical arches.

A further object of the invention is to provide a method and apparatus for producing arched wooden structures that is simple and economic, that requires a minimum of adjustments and settings, and that produces high quality arched wooden structures quickly, easily, and economically.

These and other objects, features, and advantages of the present invention will become more apparent upon review of the detailed description presented below taken in conjunction with the following illustrative drawings.

BRIEF DESCRIPTION OF THE DRAWINGS

FIG. 2 is a sectional view through a portion of the mandrel table showing the spaced ribs that form the bed of the table and the mandrel forming arms slidably captured between adjacent ribs.

FIG. 2A is a partial sectional view through a mandrel arm and the ribs between which it is captured showing the configuration of the arm and rib dovetail-like surfaces.

FIG. 3 is a partial side view of one of the mandrel forming arms showing the locking means for locking the arm in place between adjacent ribs of the bed.

DETAILED DESCRIPTION OF THE PREFERRED EMBODIMENT

Figure 1:
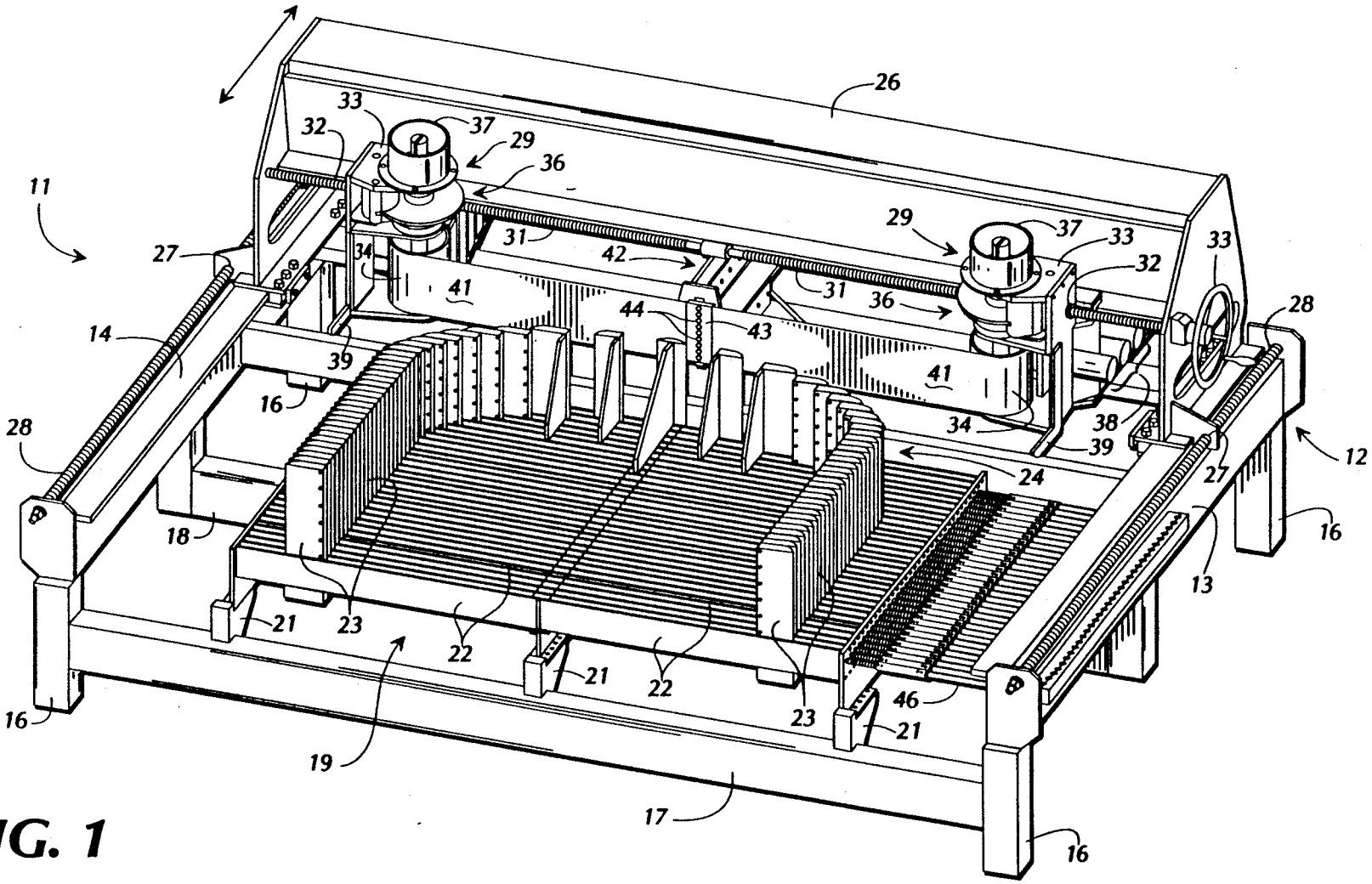
FIG. 1 is a perspective view illustrating a device that embodies principles of the present invention in a preferred form.

Referring now in more detail to the drawings, in which like numerals refer to like parts throughout the several views, FIG. 1 illustrates an apparatus 11 that embodies principals of the present invention in a preferred form. The apparatus 11 is seen to comprise a welded metal frame 12 having spaced horizontal beams 13 and 14 supported by vertical legs 16. The frame 12 also includes elongated support spars 17 and 18, which extend across the width of the apparatus 11.

A generally horizontal mandrel table assembly 19 is mounted on the frame 12 and supported by the spars 17 and 18. The entire mandrel table assembly 19 rests upon non-conductive electrical isolators 21 so that the table assembly 19 is electrically decoupled and isolated from other metal parts of the apparatus for purposes detailed hereinbelow.

The mandrel table assembly 19 includes a multitude of elongated spaced parallel ribs 22 (FIGS. 2 and 4), the upper edges of which define a substantially planar horizontal bed of the table assembly 19. A plurality of rigid metal arms 23 extend vertically upwardly from the bed of the mandrel table 19. Each of the arms 23 is slidably secured at its lower end between an adjacent pair of parallel ribs 22 that form the bed of the table 19. With this configuration, each of the arms 23 can be moved to the left or right in FIG. 1 by sliding the arm along the length of its ribs. The arms can thus be positioned as shown in FIG. 1 such that their vertical surfaces align to define an arcuate or arched shaped mandrel 24 that extends upwardly from the bed of the table 19 and about which wooden boards and the like can be bent into arched shapes. Preferably, the bed is divided into left and right-hand sides and a pair of oppositely facing arms is captured between each pair of ribs with one arm being located on the left-hand side of the table and the other arm located on the right-hand side. In this way, the arms can be adjusted in pairs to form a symmetrical mandrel as shown in FIG. 1.

A massive metal carriage assembly 26 is slidably supported at its ends upon the spaced beams 13 and 14 of the frame 12. The carriage assembly 26 is provided with threaded gussets 27 through which elongated threaded rods 28 extend. The threaded rods 28 can be rotated either manually or with an electric or hydraulic motor (not shown) to move the entire carriage assembly 26 back and forth along the beams 13 and 14 thus moving the carriage back and forth over the mandrel table assembly 19.

A pair of opposed take-up drum assemblies 29 are movably mounted to the carriage assembly 26. The take-up drum assemblies 29 can be moved along the length of the carriage assembly 26 by means of rotatable threaded rods 31 and corresponding threaded gussets 32. Preferably, the threaded rods 31 are rotatively coupled together and have opposite pitches such that rotation of the rods by means of wheel 33 moves the take-up drum assemblies 29 in unison either toward or away from one another along the length of the carriage 26.

As described in more detail below, each of the take-up drum assemblies 29 comprises a frame 33 that supports on a common axle a cylindrical take-up drum 34, a caliper brake assembly 36, and a return spring assembly 37. Each frame 33 also supports a hydraulically operated terminal clamp assembly 38, whose configuration and function will be discussed below in detail. A vertically adjustable L-shaped work piece holder 39 is also supported by each of the frames 33 of the take-up drum assemblies 29.

A strong, flexible, preferably stainless steel band 41 extends between and is wrapped at its ends around the take-up drums 34 of the take-up drum assemblies 29. The band 41 can thus be paid out from or taken up by the drums 34 as the drum assemblies move together or apart and as the carriage 26 moves forward across the mandrel table to wrap the band 41 about the mandrel 24 as detailed hereinbelow.

A hydraulically operated clamping assembly 42 is mounted to the frame 12 behind the mandrel table assembly 19 and is aligned with the center portion of the table. The clamping assembly 42 includes a generally rectangular clamping plate 43 that can be moved selectively toward the apex of a curved shaped mandrel formed on the mandrel table 19. The stainless steel band 41 is securely attached at its center to the clamping plate 43 by means of screws or bolts 44 or by other appropriate attaching means.

A threaded rod 46 (best seen in FIG. 2A) extends between each pair of the spaced ribs that form the bed of the mandrel table 19. Each rod 46 is threaded through a corresponding threaded bore in the arms 23 that are captured between the ribs 22 such that rotation of a rod 46 functions to move the corresponding arms 23 back and forth across the width of the bed of the mandrel table 19. As with rods 31, rods 46 preferably have right-hand and left-hand sections that are threaded oppositely so that rotation of a single rod moves the left-hand and right-hand arms 23 of a particular slot of the table either together or apart to facilitate the formation of symmetrical arched shapes. However, the arms could just as easily be independently adjustable to form asymmetrical mandrels and such is fully anticipated as being within the scope of the present invention.

FIG. 2 illustrates a preferred configuration of the ribs 22 and arms 23 that provides for easy sliding movement of the arms along their ribs and also provides the ability to couple and lock the entire table assembly together to form an extremely rigid substantially monolithic mandrel structure about which wooden boards can be formed. Each of the ribs 22 is seen to have a generally rectangular cross-section with opposed side surfaces 47 and 48, a top edge 49 and bottom edge 51. As best seen in FIG. 2A, the top and bottom edges 49 and 51 of each rib 22 are shaped to define longitudinal grooves 52 and 53 separated by a sloped wall central ridge 54.

Each of the upstanding arms 23 that is captured between a pair of ribs 22 has a dovetail groove 56 (FIG. 2A) formed along its right side as seen in FIG. 2A. The dovetail groove 56 is shaped and sized to receive the dovetail shaped tongue formed in the rib 22 by opposed grooves 53 on the top and bottom edges of the rib. The left-hand side of the arm 23 as seen in FIG. 2A is also formed with a dovetail groove 57 that receives the dovetail shaped tongue of the left-hand rib 22. The dovetail groove 57 on the left-hand side of arm 23 is further formed with surfaces 58 that are shaped and sized to abut against the slanted walls of the central ridge 54 formed in the rib 22 when the arm 23 is locked into position as detailed below. In this way, each arm, when locked, is forced firmly against its right-hand rib as seen in FIG. 2A and, when all arms are so locked, the entire table structure becomes mechanically coupled and locked together to form a rigid monolithic mandrel structure that resists flexure and undesirable movement during use.

The means for locking each of the arms 23 into a desired position on the mandrel table while also locking the table into its monolithic configuration is best illustrated in FIGS. 2 and 3. Each of the arms 23 extends downwardly into a groove between adjacent ribs 22 to a lower end 59. A threaded rod 61 is secured into the lower end 59 of each arm 23 and extends downwardly therefrom to a threaded lower end 62. A locking block 63 having a central bore 64 is loosely received on the rod 61 and is captured there by means of a rectangular shaped pivot block 66, washers 67, and lock nut 68, which is threaded onto the lower end 62 of rod 61. As best seen in FIG. 3, the locking block 63 and lower end of arm 23 are each machined so that together they form the dovetail grooves 56 and 57 shown in FIG. 2A. Also, on the side of the arm visible in FIG. 3, the additional abutting surfaces 58 are seen to be formed in the lower part of arm 23 and in the locking block 63.

A cylindrical pivot bearing 71 is captured in cylindrical grooves formed in the bottom of the locking block 63 and the top of the pivot block 66 on one side of the rod 61. A small hydraulic piston assembly 72 is embedded within the block 63 and has its piston 73 extending downwardly to engage the top portion of the pivot block 66 as shown. A hydraulic supply line 74 is configured selectively to deliver hydraulic fluid under pressure to the piston assembly 72 thus extending the piston 73 against the pivot block 66. When this happens, the pivot block 66 pivots about pivot pin 66 downwardly to the left in FIG. 3, thus imparting upward force to the locking block 63 forcing it toward the bottom of the arm 23. As can be appreciated from FIGS. 2 and 2A, this causes the dovetail shaped grooves formed in the arms and locking block to clamp down onto the respective dovetail shaped tongues of the corresponding ribs thus locking the arm securely in position on its ribs. In addition, when so locked, the abutting surfaces 58 firmly engage the sloped walls of central ridges 54 thus forcing the arm 23 tightly against the left side surface 48 of the right-most rib as seen in FIG. 2A. Thus, the arm becomes locked tightly between the ribs and is secured against side-to-side movement. In addition, when all of the arms of the mandrel table assembly are thus locked into position, the entire assembly becomes tightly mechanically coupled and locked together to form an extraordinarily rigid monolithic mandrel structure that is virtually free of undesirable flexing and bending even under the extreme forces and pressures applied during use of the machine. To unlock the arms and the mandrel table, hydraulic pressure is simply released through supply line 74, which lowers the locking block 63 allowing the arms to slide freely along the ribs between which they are captured.

Figure 4:
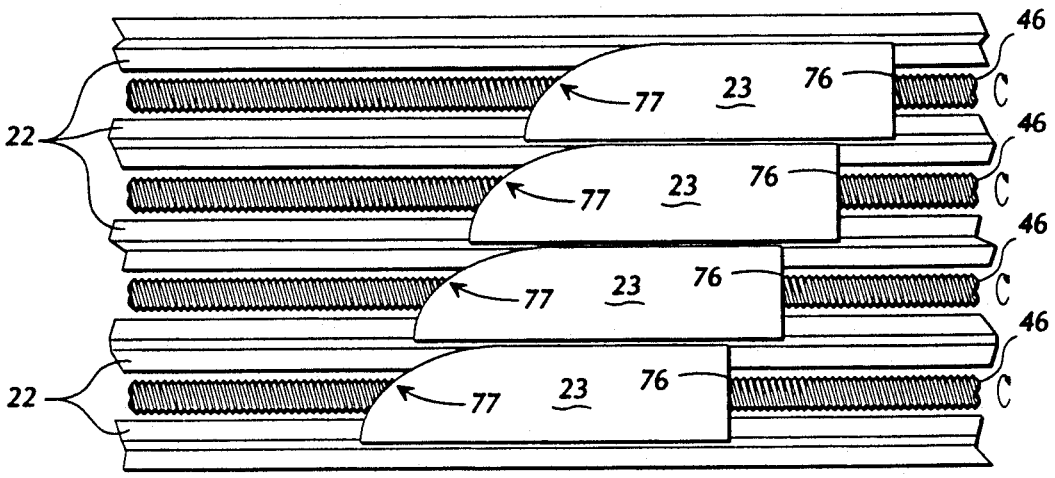
FIG. 4 is a top plan view of a portion of the mandrel table showing the cross-sectional shape of the arms and the threaded rods that are used to move the arms across the width of the table.

FIG. 4 is a top plan view of a portion of the mandrel table assembly 19 showing the cross-sectional shapes of the upstanding arms and the threaded rods by means of which the arms are moved along their respective ribs. More specifically, the arms 23 are seen to be positioned between their respective ribs so that they can move past one another along the table. Threaded rods 46 are threaded through respective bores 45 (FIG. 2) so that rotation of one of the rods 46 moves the corresponding arm 23 to the left or right as seen in FIG. 4 across the width of the bed of the mandrel table assembly 19.

Each of the arms 23 preferably is formed of extruded or machined aluminum and has an inside vertical edge 76 that is substantially square and an outside vertical edge 77 that has a curved or arcuate shape. While the shape of outside vertical edge 77 could conform to various types of curves, it has been found advantageous that the shape be one quadrant of an ellipse. With this configuration, and referring to FIG. 1, when the arms are packed closely together at the end portions of an arched mandrel, numerous and closely spaced points of contact are provided on the tips of the elliptical shaped vertical edges 77 to provide adequate support for the work piece being bent. Conversely, when the arms are not so tightly packed such as, for example, in the arching portion of the curve where the contact points are fewer and spaced further apart, a broader section of the elliptical curved shape of each arm is presented to the work piece to provide additional support and prevent a sectioned looking curve that might result if the work piece engaged the arms along narrow lines rather than broad areas. Thus, the elliptical shape of edges 77 provides for adequate support of the work piece along all sections of the arch about which it is to be bent.

Figure 5:
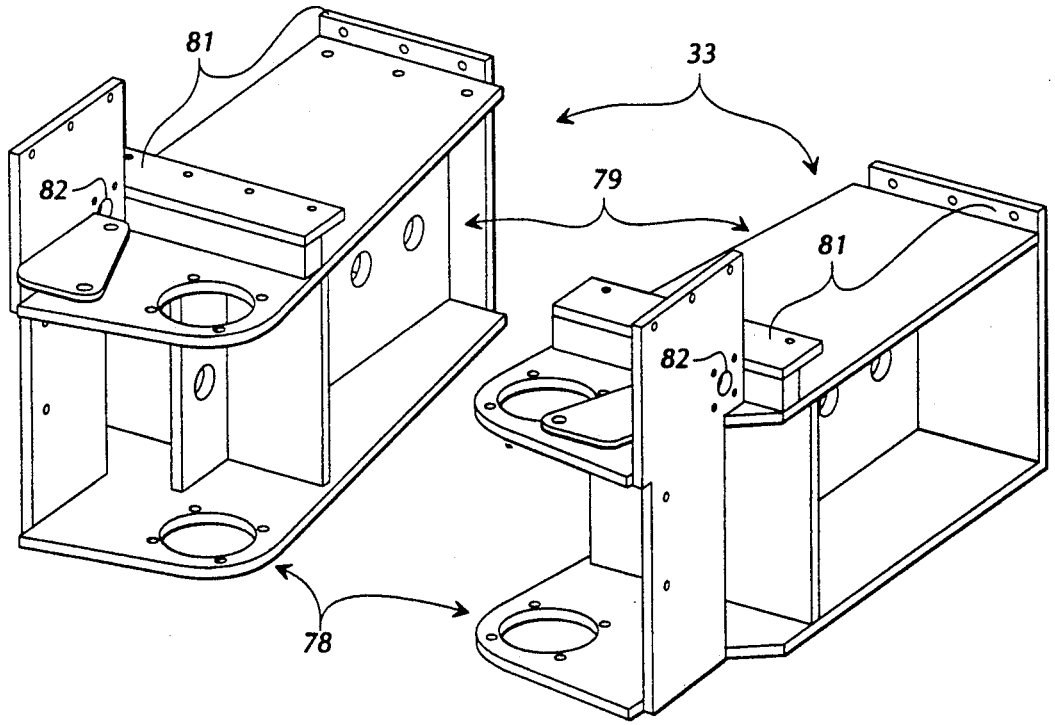
FIG. 5 illustrates the drum assembly frames to which the take-up drums, caliper brakes, and terminal clamp assemblies are mounted.

FIG. 5 is a detailed illustration of the frames 33 that support the operative elements of the take-up drum assemblies 29. The frames 33 preferably are formed from heavy welded metal plates to support the take-up drum assembly and to provide a rigid structure for wrapping the stainless steel band about the mandrel. Each of the frames 33 is formed with a forward portion 78 configured to support the take-up drum, caliper brake, and spring assembly (FIG. 1) and a rear end portion 79 configured to support the hydraulically operated terminal clamp assembly 38. Mounting brackets 81 are provided for slidably mounting the frames 33 on the carriage 26 and bores 82 are provided to accept the threaded gussets 32 and threaded rods 31 for moving the frames and take-up drum assemblies together and apart along the length of carriage 26.

Figure 6:
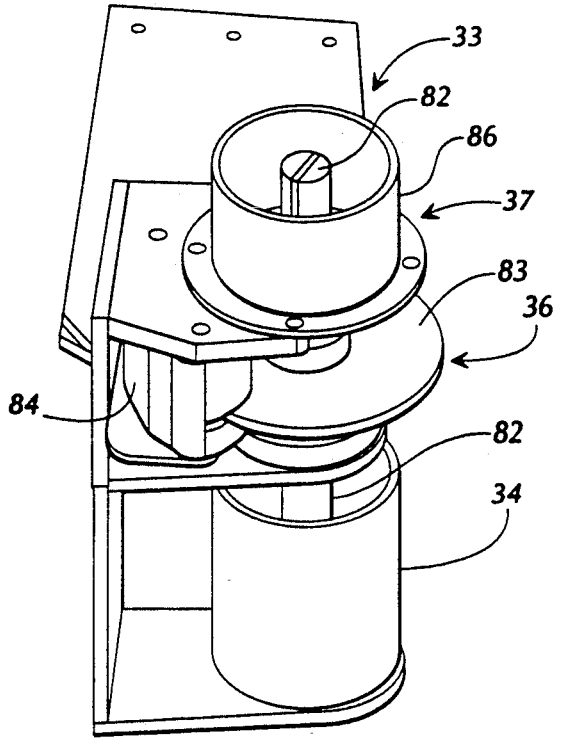
FIG. 6 illustrates a preferred embodiment of the take-up drum assembly for paying out the stainless steel band and wrapping it about a mandrel formed by the arms of the mandrel table.

FIG. 6 illustrates a preferred embodiment of the take-up drum, caliper brake, and return spring arrangement of one of the take-up drum assemblies 29. Each of these elements is seen to be mounted to a common axle 82 that rotates with the take-up drum 34. More specifically, as the drum 34 rotates when paying out the stainless steel band, so does the disk 83 of the caliper brake assembly 36. Hydraulically activated calipers 84 can be engaged to clamp onto the rotating disk 83 to provide selective resistance to rotation of the drum 34. In this way, the amount of tension imparted to the stainless steel band as it is wrapped around the mandrel can be controlled by judicious selection of force applied by the calipers 84 to the rotating disk 83. Increased tension might, for example, be imparted to the band when forming arcuate wooden structures of thick or heavy woods where additional force is needed to bend the wood about the mandrel. Finally, return spring assembly 37 comprises a spring housing 86 that carries a large coil spring (not shown) coupled to the housing and to the shaft 82. The spring is oriented to urge the axle 82 and thus drum 34 in a reverse direction so as to wind the stainless steel band back up onto the drum as the board is unwound from about the mandrel. This prevents the stainless steel band from becoming loose and perhaps tangled up in other working elements of the device.

Figure 7:
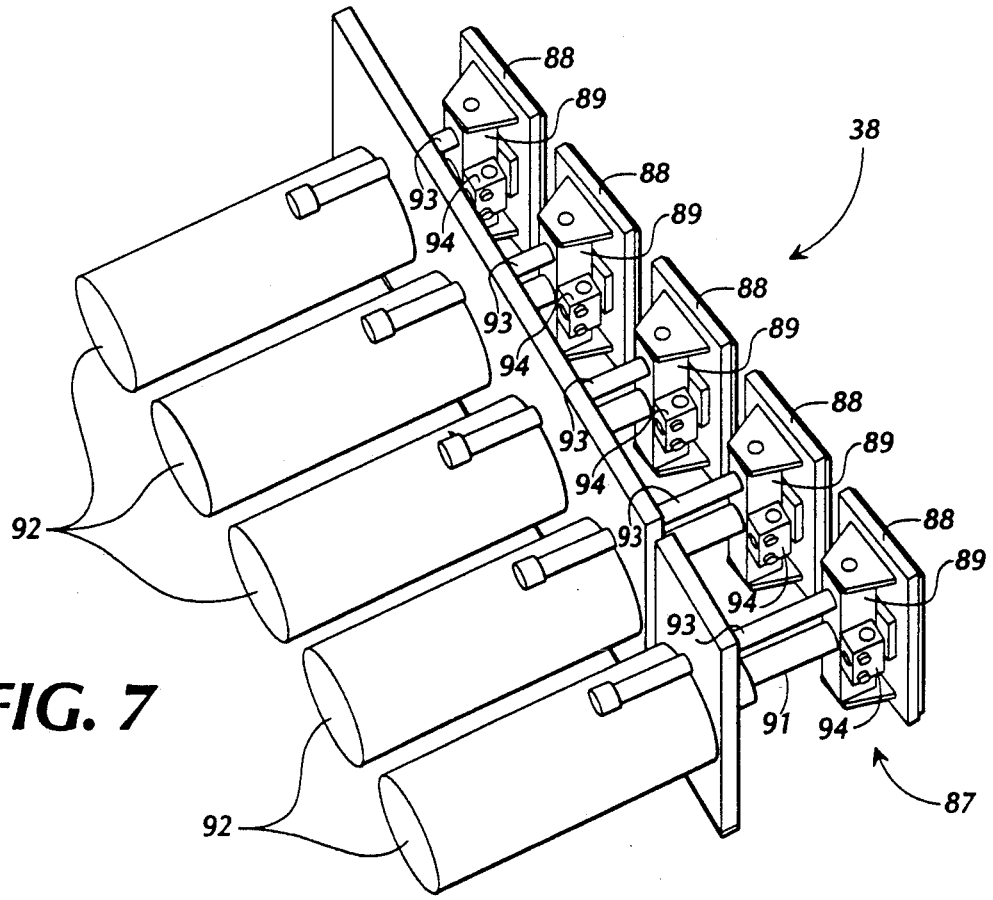
FIG. 7 illustrates a preferred embodiment of the hydraulic terminal clamp assembly that clamps a work piece against a straight or flat portion of an arched mandrel adjacent the ends thereof.

FIG. 7 is a detailed illustration of the hydraulically operated terminal clamp assembly 38 that is mounted to the rear end portion 79 of each frame 33. As described in more detail below, and as best shown in FIGS. 8A–8E, the function of this terminal clamp assembly is to apply additional pressure to the work piece at the terminal or straight end portions of an arch about which the piece has been bent. Such additional force is necessary since the stainless steel band applies very little force in these regions of the arch as they are not curved like other regions of the mandrel.

In the preferred and illustrated embodiment, the terminal clamp assembly includes five hydraulically operated clamps. Each of the clamps includes a clamp pad assembly 87, which preferably is formed by a generally rectangular clamp pad 88 that is vertically pivotally mounted to a clamp pad block 89. Each clamp pad block 89 in turn is secured to the end of a respective piston rod 91 that can be selectively extended from a hydraulic cylinder 92. Stabilizing rods 93 are provided to insure that the clamp pads are maintained in a vertical orientation with respect to the work piece. Limit switches 94 preferably are provided on each clamp pad assembly 87 to detect when a clamp pad 88 has pivoted beyond a predetermined angle and, in response, to retract the clamp pad 88 by causing the retraction of piston rod 91. In this way, should one of the clamp pads be extended against a curved rather than flat section of the arcuate shape, the clamp pad will automatically be retracted so as not to impart undue force and pressure on the work piece at a position where the result of such force could be detrimental.

OPERATION

The operation of the apparatus described above to perform the method of this invention will be described with reference to FIGS. 8A–8E. In these figures, elements of the invention not directly involved in its operation have been omitted in order that the method be understood with clarity.

Initially, a mandrel 24 having the desired arcuate shape is formed by positioning the arms 23 in appropriate locations on the bed of the mandrel table assembly 19. Once positioned, the arms 23 are securely locked in place thus coupling and locking together the entire mandrel assembly into a rigid monolithic mandrel structure. In FIGS. 8A–8E, the mandrel 24 is shown to be formed in the shape of a cathedral arch, which is easily formed with the present invention but which has been virtually impossible to form with prior art automated devices.

With the mandrel shape thus formed and locked into position, a work piece 100 in the shape of a long board is formed by applying adhesive to a number of thin planks and stacking the planks together to form a laminate. The work piece 100 is then placed in the machine where it rests upon the work piece holders 39 and has its center portion positioned adjacent the apex of the mandrel 24 as shown. The positioning of work piece supports 39 between the ends of the work piece and its center help to average out and minimize any lateral warping that might be present in the individual planks of the laminated work piece board. With the machine thus set up and the work piece in position, the method of this invention can be performed as illustrated in FIGS. 8B–8E.

Initially, the take-up drum assemblies are adjusted along the carriage 26 to position the take-up drums 34 just beyond the widest extent of the mandrel 24 plus the thickness of the work piece 100. In this way, as the carriage 26 and take-up drum assemblies move downwardly toward the terminal ends of the mandrel, the drums will just clear the outside surface of the work piece and will not engage and apply undue pressure to the work piece or the mandrel.

With the take-up drum assemblies thus positioned, the clamping plate 43 is extended toward engagement with the work piece 100 by means of a hydraulic cylinder 96. As the clamping plate 43 engages the work piece, it applies substantial pressure thereto to clamp the work piece securely between the clamping plate 43 and the apex of the mandrel 24. This procedure both sets the planks of the work piece in place and insures that the work piece will not separate from the mandrel in the region of the apex as with prior art devices.

Figure 8A:
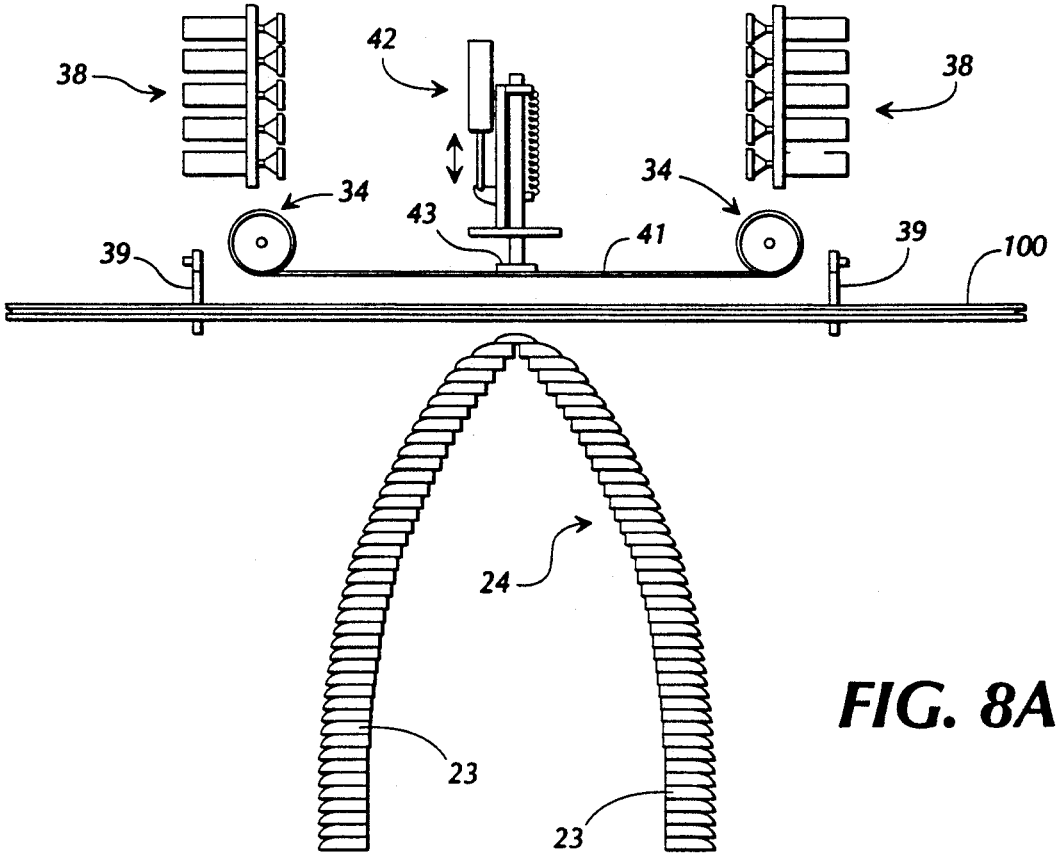
FIGS. 8A–8E represent progressively the method of the present invention when used to fabricate an arched wooden structure having a cathedral shape.
Figure 8B:
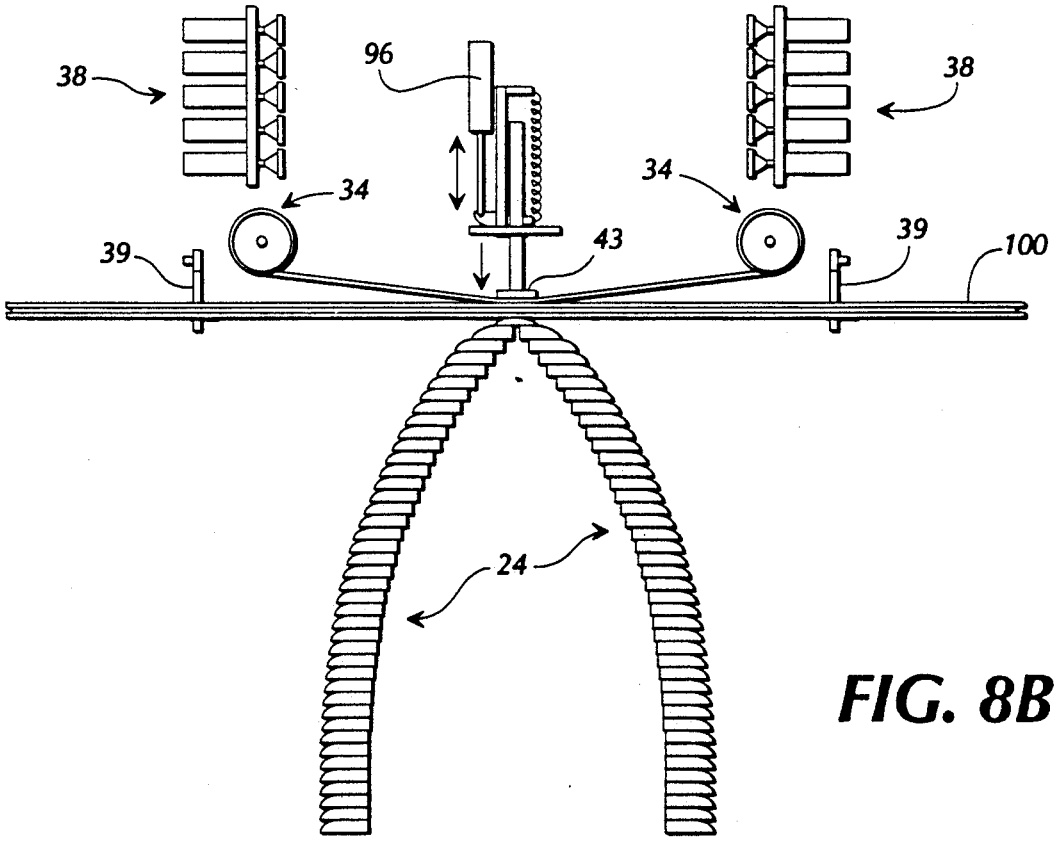
Figure 8C:
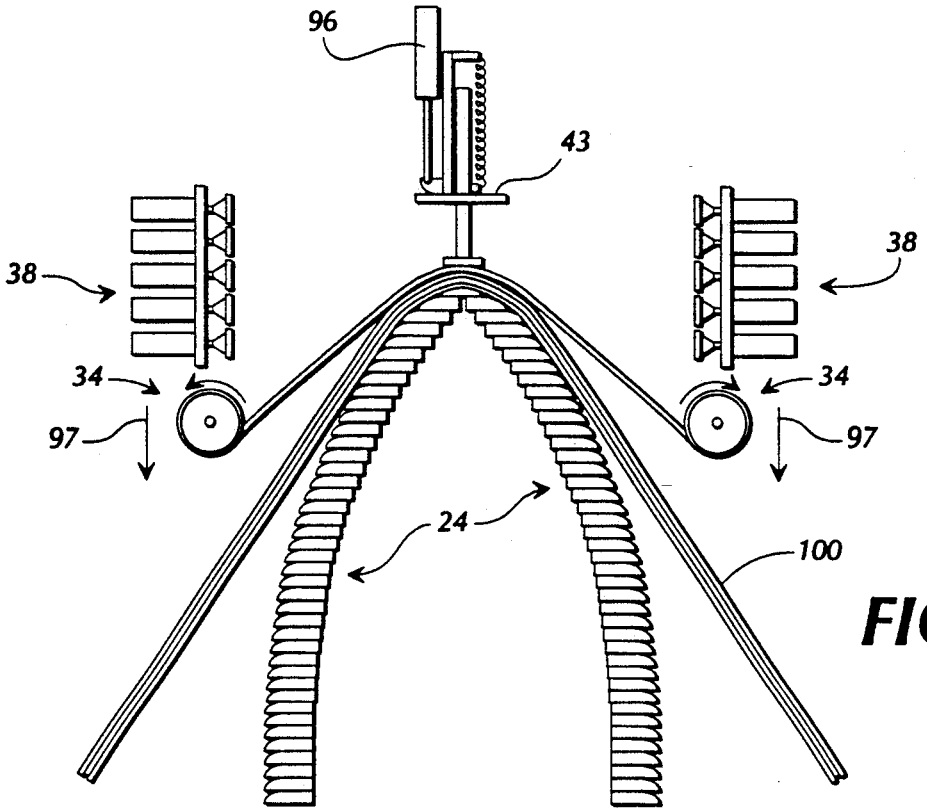

As illustrated in FIG. 8C, with the work piece clamped intermediate its ends at the apex of the mandrel, the carriage 26 is activated to move slowly as indicated by arrows 97 from the apex end of the mandrel 24 toward the terminal ends thereof. As the carriage moves, carrying the take-up drum assemblies with it, the stainless steel band 41 is slowly paid out from the take-up drums 34 against the substantial resistance provided by the caliper brake assembly 36. Extreme tension is thus imparted to the band 41, which provides sufficient force to begin to bend and wrap the work piece 100 about the surface of the mandrel 24. Since the band is wrapped from the apex of the mandrel progressively toward the terminal ends thereof, the individual planks of the work piece are progressively gathered and pressed together and against the mandrel to provide smooth and even glue flow and prevent gaps and imperfections that have plagued the prior art. Thus, the work piece is progressively gathered and firmly held against the mandrel as the band 41 wraps about and captures the work piece against the mandrel.

Figure 8D:
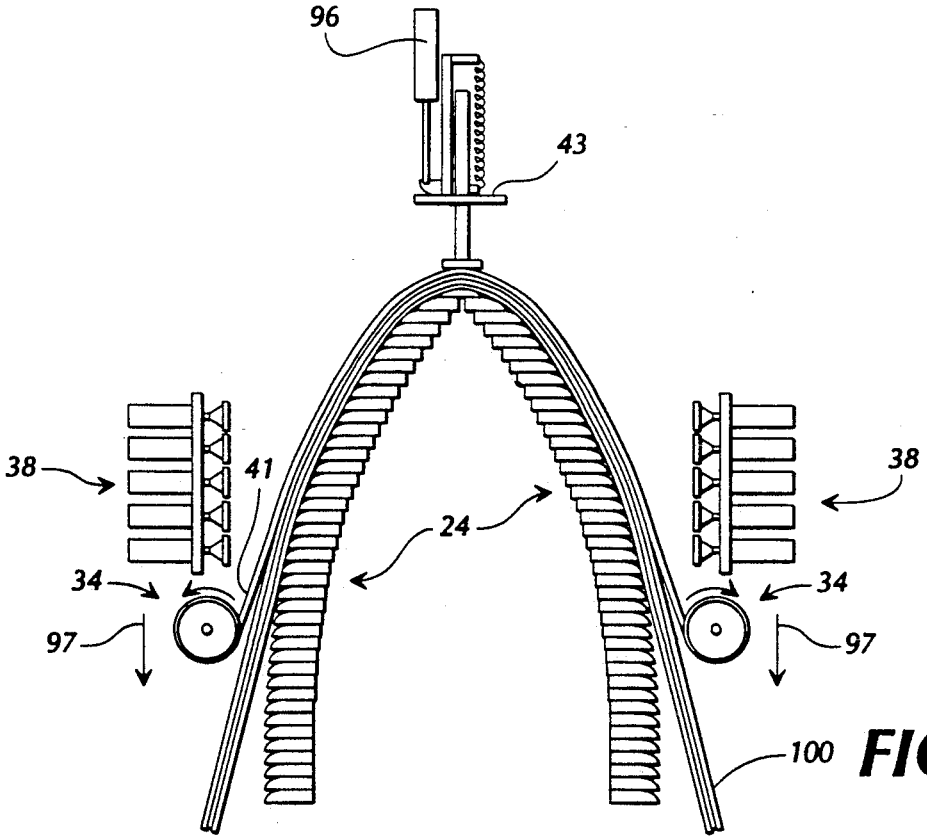

FIG. 8D represents further progressive shaping of the work piece 100 about the mandrel 24 as the carriage 26 moves further toward the terminal ends of the mandrel. Here, the work piece is seen to have been gathered together and held tightly by the band 41 against the curved portion of the mandrel 24 on either side of its apex. This is possible in large part because the work piece is securely captured and clamped at the apex of the mandrel by means of the clamp face 43, which prevents the work piece from pulling away from the mandrel at and in the region of the apex. It will be seen from FIGS. 8A–8D that the terminal clamp assembly 38 moves along with the take-up drums 34 since they are both secured to the carriage 26 by means of the take-up drum assembly frames 33. However, to this point in the method, the terminal clamp assemblies have performed no function.

Figure 8E:
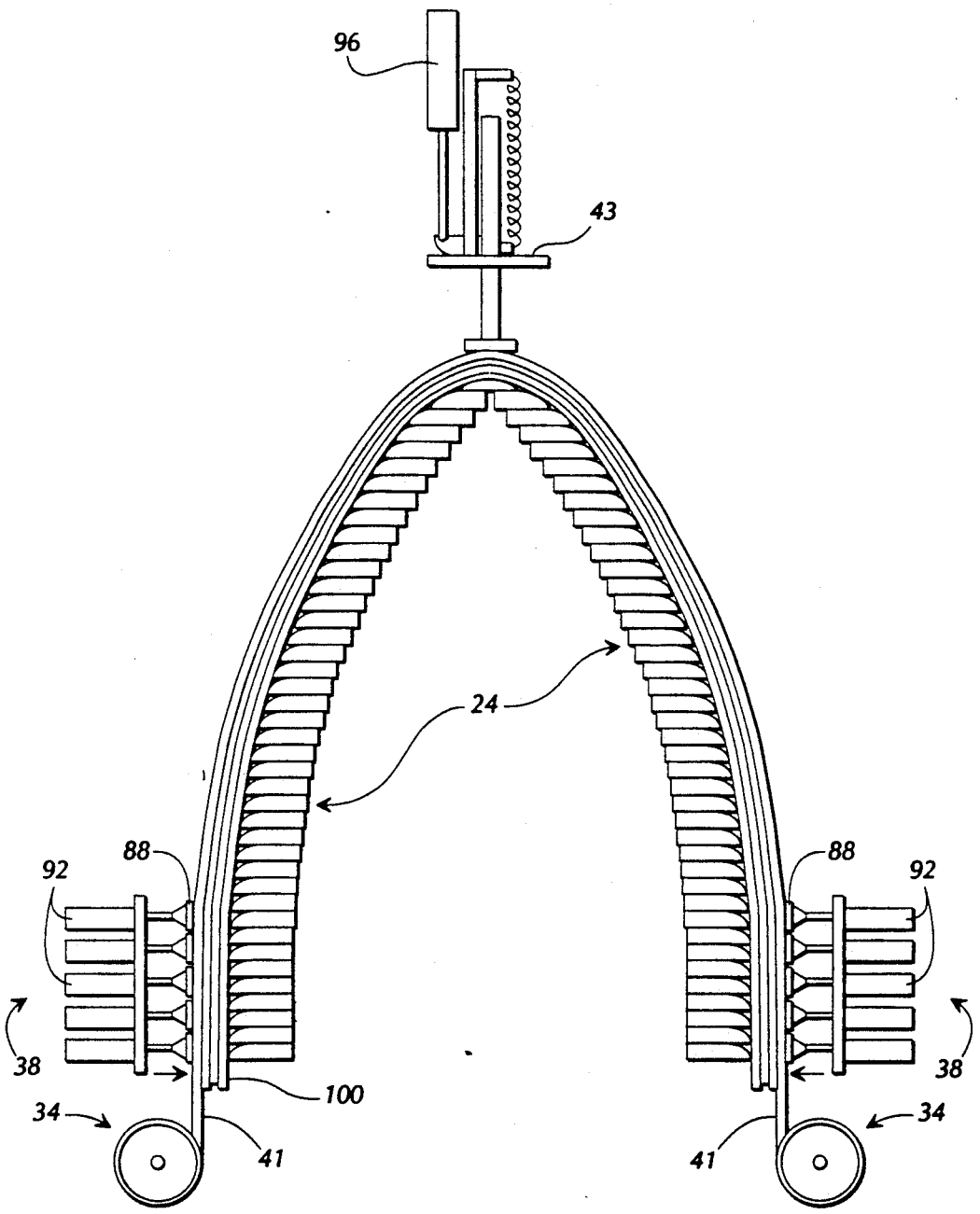

FIG. 8E illustrates the final stage of the process of fabricating the arcuate wooden structure with the method and apparatus of this invention. Here, it will be seen that the take-up drums 34 have moved slightly beyond the terminal ends of the mandrel 24 such that the terminal clamp assemblies 38 are positioned adjacent to such terminal ends. With the terminal clamp assemblies thus positioned, their hydraulic cylinders 92 are activated to extend the clamp pads 88 into firm engagement with the band 41 thus applying substantial clamping pressure to the terminal end portions of the work piece 100. Such pressure insures that the terminal end portion of the work piece, which usually is straight rather than curved, is securely adhered together since very little lateral pressure is applied to the work piece by the stainless steel band in this region.

With the work piece wrapped about and clamped securely against the mandrel 24, it is left for the adhesive to cure between the planks of the laminated board. To speed this process along, traditional methods of curing the adhesive, such as, for example, high voltage high frequency current passed through the work piece, can be utilized. For such purposes, the mandrel table assembly 19 is isolated from other conductive parts of the apparatus such that the mandrel assembly and the stainless steel band can be oppositely charged with a high voltage high frequency generator. In this way, high frequency current passes through the work piece from the mandrel arms to the stainless steel band thus heating and curing the adhesive more rapidly in the work piece.

When the adhesive is sufficiently cured, the process illustrated in FIGS. 8A–8E is simply reversed and the stainless steel band is unwound from about the mandrel and work piece. The work piece, however, retains the shape of the mandrel since the planks of its laminated structure have been securely adhered together about the mandrel. The work piece can then be removed from the apparatus for further machining and finishing whereupon the next mandrel shape can be selected and the next arched wooden structure formed as described.

The invention has been described herein in terms of preferred embodiments and methodologies that are illustrative of the invention. It will be obvious to those of skill in this art, however, that numerous additions, deletions, and modifications might be made to the illustrated embodiments without departing from the spirit and scope of the invention. For example, virtually every aspect of machine operation could easily be controlled by means of a computer based command and control station. With such computer control, an automated rotary motor could be provided to rotate the threaded rods of the mandrel table according to computer commands to position the mandrel arms according to preset criteria to form mandrels of many pre-stored shapes easily and quickly. In addition, while the invention has been described with matched pairs of mandrel arms coupled for simultaneous mirrored movement, it will be obvious that each arm of the pair could be moved independently and separately so that non-symmetrical curved shaped mandrels could easily be formed with the apparatus of this invention. Also, with the mandrel shape known by the computer control means, a linear measuring device could easily be installed on the clamping assembly 42 such that the clamp face 43 not only would clamp the work piece in position but the extent of its movement would indicate the thickness of the work piece. This thickness could then be used to set the positions of the take-up drum assemblies along the carriage 26 automatically and in response to computer commands. Obviously, these and many other modifications and improvements might be made to the illustrated preferred embodiments disclosed herein while nevertheless remaining clearly within the scope and spirit of the present invention as set forth in the claims.

I claim:

1. An apparatus for producing arcuate structural members comprising:

a frame;

a substantially planar bed secured to said frame;

means on said bed for forming a mandrel having an arcuate shape corresponding to the shape of arcuate structural members to be produced;

means for clamping the intermediate portion of an elongated work piece to said mandrel at a position intermediate the ends of the mandrel;

first means for applying and holding pressure on said work piece progressively from the clamped portion of the work piece toward one end of said arcuate shaped mandrel to bend a first section of the work piece about and hold it firmly against the mandrel; and second means for applying and holding pressure on said work piece progressively from the clamped portion of the work piece toward the other end of said arcuate shaped mandrel to bend a second section of the work piece about and hold it firmly against the mandrel.

2. An apparatus for producing arcuate structural members as claimed in claim 1 and wherein said means on said bed for forming a mandrel comprises a plurality of elongated arms movably mounted to and extending outwardly from said bed, said arms each being positionable on said bed so that together the arms define and form said arcuate shaped mandrel.

3. An apparatus for producing arcuate structural members as claimed in claim 2 and further comprising means for locking said arms securely to said bed when the arms are in their mandrel defining positions to form a substantially rigid mandrel structure on said bed.

4. An apparatus for producing arcuate structural members as claimed in claim 2 and wherein said bed is formed by a plurality of elongated spaced parallel ribs and wherein each of said arms is slidably mounted at one end between a corresponding adjacent pair of said ribs.

5. An apparatus for producing arcuate structural members as claimed in claim 4 and further comprising locking means for locking each of said arms in its mandrel defining position on said bed while simultaneously coupling and locking said arms and said bed together to form a rigid monolithic structure substantially resistant to flexure and movement as arcuate structural members are bent and formed about the mandrel.

6. An apparatus for producing arcuate structural members as claimed in claim 5 and wherein said locking means comprises means on each of said arms for selectively and releasably gripping the adjacent ribs between which the arm is slidably mounted.

7. An apparatus for producing arcuate structural members as claimed in claim 1 and wherein each means for clamping the intermediate portion of the work piece to said mandrel comprises a ram member having a clamping head, said ram member being adapted to move said clamping head selectively and releasably into clamping engagement with a work piece positioned adjacent said mandrel to clamp the work piece securely to the mandrel.

8. An apparatus for producing arcuate structural members as claimed in claim 1 and wherein said first means for applying and holding pressure on said work piece progressively from the clamped portion of the work piece to one end of the mandrel comprises a flexible band and means for wrapping said flexible band progressively and tightly about said mandrel with the work piece firmly captured between said flexible band and said mandrel whereby the work piece is progressively bent about and conformed to the shape of the mandrel.

9. An apparatus for producing arcuate structural members as claimed in claim 8 and wherein said second means for applying and holding pressure on the work piece progressively from the clamped portion of the work piece to the other end of the mandrel comprises a flexible band and means for wrapping said flexible band progressively and tightly about said mandrel with the work piece firmly captured between said flexible band and said mandrel whereby the work piece is progressively bent about and conformed to the shape of the mandrel.

10. A method of forming an elongated work piece into an arcuate shape with said method comprising the steps of:

(a) forming a mandrel having an arcuate shape corresponding to the desired finished shape of the work piece, said arcuate shape defining ends and an intermediate portion of the mandrel;

(b) clamping an intermediate portion of the work piece to the mandrel at a position intermediate the ends of the mandrel;

(c) applying and holding pressure on the work piece progressively from the clamped portion of the work piece toward one end of said arcuate shaped mandrel to bend a first section of the work piece progressively about and hold it firmly against the mandrel;

(d) applying and holding pressure on the work piece progressively from the clamped portion of the work piece toward the other end of said arcuate shaped mandrel to bend a second section of the work piece progressively about and hold it firmly against the mandrel; and (e) securing the work piece for a predetermined time in position about the mandrel.

11. A method of forming an elongated work piece into an arcuate shape as claimed in claim 10 and wherein step (a) comprises providing a substantially planar bed having a plurality of elongated arms movably mounted to and extending outwardly from the bed and moving the arms to predetermined locations on the bed so that the arms together define and form the arcuate shaped mandrel.

12. A method of forming an elongated work piece into an arcuate shape as claimed in claim 10 and wherein step (b) comprises locating the work piece adjacent the mandrel and moving a clamping surface into engagement with the work piece to capture and clamp the work piece between the clamping surface and the mandrel.

13. A method of forming an elongated work piece into an arcuate shape as claimed in claim 10 and wherein step (c) comprises wrapping a flexible band progressively and tightly about the mandrel with the work piece being progressively captured between the flexible band and the mandrel.

14. A method of forming an elongated work piece into an arcuate shape as claimed in claim 10 and wherein step (d) comprises wrapping a flexible band progressively and tightly about the mandrel with the work piece being progressively captured between the flexible band and the mandrel.

15. A method of fabricating an arched laminated structure comprising the steps of:

(a) applying adhesive to the surfaces of a plurality of planks or the like;

(b) gathering the planks together in a stacked configuration with the adhesive between adjacent planks of the stack to form an elongated work piece having ends;

(c) clamping the work piece intermediate its ends to a substantially rigid arched form;

(d) progressively applying and holding pressure to the work piece from the clamped portion of the work piece toward one end thereof to gather one section of the work piece progressively toward and hold it against the form;

(e) progressively applying and holding pressure to the work piece from the clamped portion of the work piece toward the other end thereof to gather the other section of the work piece progressively toward and hold it against the form; and (f) maintaining the work piece in position about the form for a time sufficient to cure the adhesive, whereby the work piece is progressively conformed to the arched shape of the form and retains the arched shape of the form when removed therefrom.

16. The method of claim 15 and wherein steps (d) and (e) are performed simultaneously.

17. A mandrel table usable in the fabrication of arched wooden structures, said mandrel table comprising a plurality of elongated spaced parallel ribs mutually aligned to define a substantially planar bed, a plurality of elongated rigid arms extending outwardly from said bed, each of said arms having a first end and a second end and being slidably mounted at its first end between a corresponding pair of spaced parallel ribs for selective movement of the arm along the lengths of its corresponding ribs, and means for locking each of said arms to said corresponding pair of spaced parallel ribs at a selected position along the length thereof, said arms and said ribs, when mutually locked together, forming a rigid interlocking monolithic structure, whereby the arms can be moved to selected positions on the bed together to define and form an arched mandrel extending outwardly from the bed about which lengths of wood and the like can be bent to form arched structures.

18. The mandrel table of claim 17 and wherein said locking means further comprises means for mechanically coupling and locking said ribs and said arms together to form a rigid monolithic mandrel structure when said locking means is activated and for decoupling said ribs and said arms to permit free sliding movement of said arms when said locking means is deactivated.

* * * * *